US006360462B1

(12) United States Patent
Mengel

(10) Patent No.: US 6,360,462 B1
(45) Date of Patent: Mar. 26, 2002

(54) CONTAINER WITH LABEL

(75) Inventor: Ronald E. Mengel, Ambler, PA (US)

(73) Assignee: McNeil-PPC, Inc., Skillman, NJ (US)

( * ) Notice: Subject to any disclaimer, the term of this patent is extended or adjusted under 35 U.S.C. 154(b) by 0 days.

(21) Appl. No.: 09/546,345

(22) Filed: Apr. 10, 2000

(51) Int. Cl.[7] ..... G09F 3/00
(52) U.S. Cl. ..... 40/310; 40/306
(58) Field of Search ..... 40/306, 310, 506; 283/81; 428/40.1

(56) References Cited

U.S. PATENT DOCUMENTS

| | | | | |
|---|---|---|---|---|
| 2,013,616 | A | 9/1935 | Rettenmeyer | 220/1 |
| 2,860,431 | A | 11/1958 | Barnum, Jr. | 40/61 |
| 4,592,572 | A | 6/1986 | Instance | 281/2 |
| 4,621,442 | A | 11/1986 | Mack | 40/2 R |
| 4,621,837 | A | 11/1986 | Mack | 283/105 |
| 4,711,686 | A | 12/1987 | Instance | 156/227 |
| 4,724,973 | A | 2/1988 | Shah | 215/246 |
| 4,877,119 | A | 10/1989 | Hosking | 206/459 |
| 5,074,595 | A | 12/1991 | Hill et al. | 283/81 |
| 5,234,735 | A | 8/1993 | Baker et al. | 428/40 |
| 5,403,636 | A | 4/1995 | Crum | 428/40 |
| 5,727,819 | A | 3/1998 | Grosskopf et al. | 283/81 |
| 5,738,382 | A | 4/1998 | Grosskopf et al. | 283/81 |
| 5,766,716 | A | 6/1998 | Barry | 428/40.1 |
| 5,804,271 | A | 9/1998 | Barry | 428/40.1 |
| 5,809,674 | A | 9/1998 | Key | 40/306 |
| 5,829,789 | A | 11/1998 | Treleaven | 283/81 |
| 5,830,550 | A | 11/1998 | Treleaven et al. | 428/40.1 |
| 5,863,628 | A | 1/1999 | Barry | 428/40.1 |
| 5,866,219 | A | 2/1999 | McClure et al. | 428/40.1 |
| 5,884,421 | A | 3/1999 | Key | 40/306 |
| 5,975,582 | A | 11/1999 | Treleaven | 283/81 |
| 6,086,697 | A * | 7/2000 | Key | 156/215 |
| 6,129,802 | A * | 10/2000 | Key | 156/229 |

* cited by examiner

*Primary Examiner*—Christopher P. Schwartz

(57) ABSTRACT

The present invention is directed to containers with a informational package which is retractable upon the rotation of the container. This allows the informational package to be readily available when needed, but protected within the inner sleeve when not in use. The information package can be provided in various forms such as a booklet or in pamphlet form.

18 Claims, 9 Drawing Sheets

CONTAINER WITH LABEL

FIELD OF THE INVENTION

The present invention relates a container, in particular, a container with a information package that can retract when not in use.

BACKGROUND OF THE INVENTION

Many containers have the need to provide health and safety information about their contents to consumers. As the need to provide more information increases, labels have become more crowded and difficult to read. Some have attempted to solve this problem by resorting to smaller type, which leads to further difficulty reading and understanding the label directions.

Other attempts to solve these problems has lead to the development of rotatable labels as described in U.S. Pat. No. 5,884,421. This allows an improvement in the presentation of the format of the material, although the amount of information presented does not increase significantly.

Another technique used in increasing the amount of information provided with a container is described in U.S. Pat. No. 5,866,219. In this system, a base member and a fold out pamphlet is applied to medicinal and drug containers. The foldout pamphlet is removable and resealable for subsequent use.

Despite these disclosures there is a continuing need for labels on containers that can provide large amounts of information when needed, but preferably would be hidden when not required.

SUMMARY OF THE INVENTION

The present invention provides an outer sleeve which when rotated extends an information package out of an aperture in the outer sleeve. Preferably the information is provided in a booklet form, or in a folded package. After the information is read and understood by the consumer the information package is retracted through the window inside the outer sleeve.

In a first embodiment, the invention comprises a product information label system comprising:

a) a container suitable for holding material;

b) an inner sleeve in contact with said container;

c) an outer sleeve in contact with the inner sleeve;

d) a window in said outer sleeve;

e) an information package; wherein said information package is extended through said window when the container is rotated.

Another embodiment of the invention provides a method for providing information to a consumer regarding the contents of the container comprising:

providing a container;

providing an inner sleeve in contact with the container;

providing an outer sleeve in contact with the inner sleeve;

providing a window in the outer sleeve;

providing an information package with the outer sleeve;

rotating the container to provide the information package through the window in the outer sleeve.

These and other embodiments of the invention will become apparent when reviewing the drawings and specification.

DETAILED DESCRIPTION OF THE PREFERRED EMBODIMENTS

The invention together with the above and other objects may best be understood from a consideration of the following detailed description of an illustrative embodiment in the course of which reference is made to the accompanying drawings.

Figure 4A:
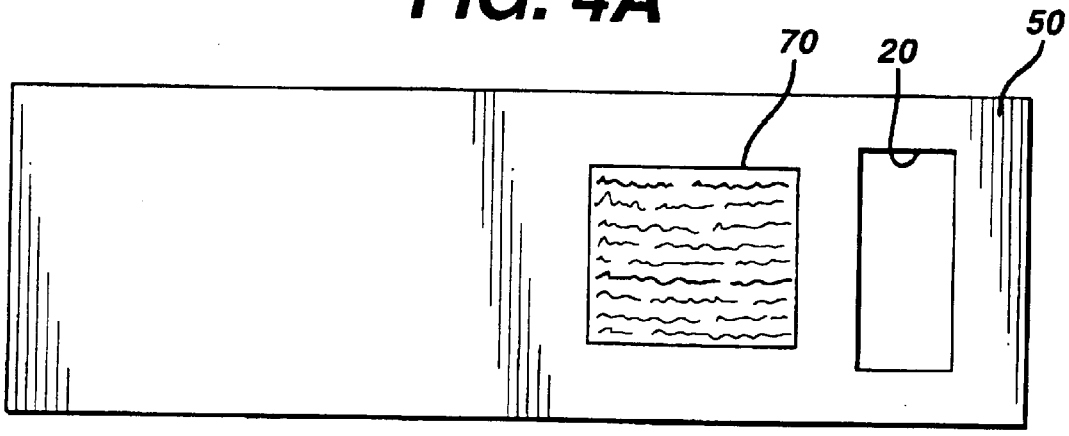
Figure 4B:
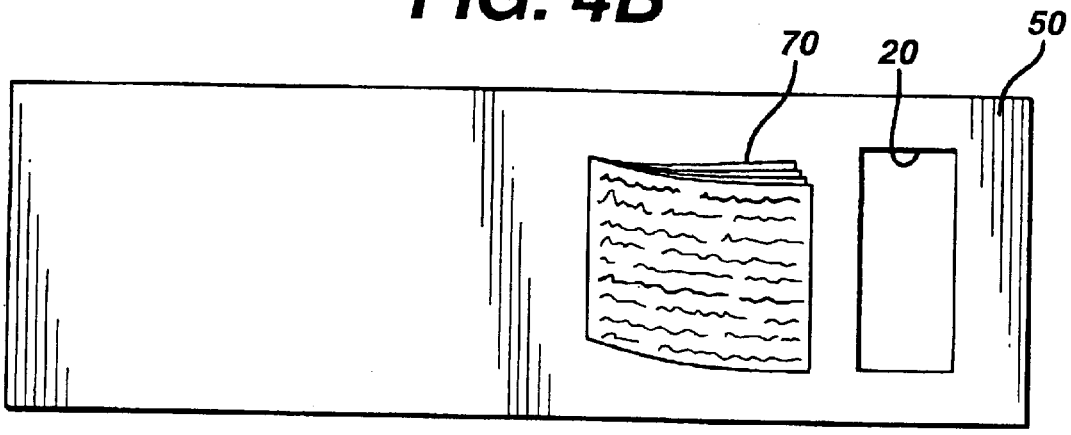
Figure 4C:
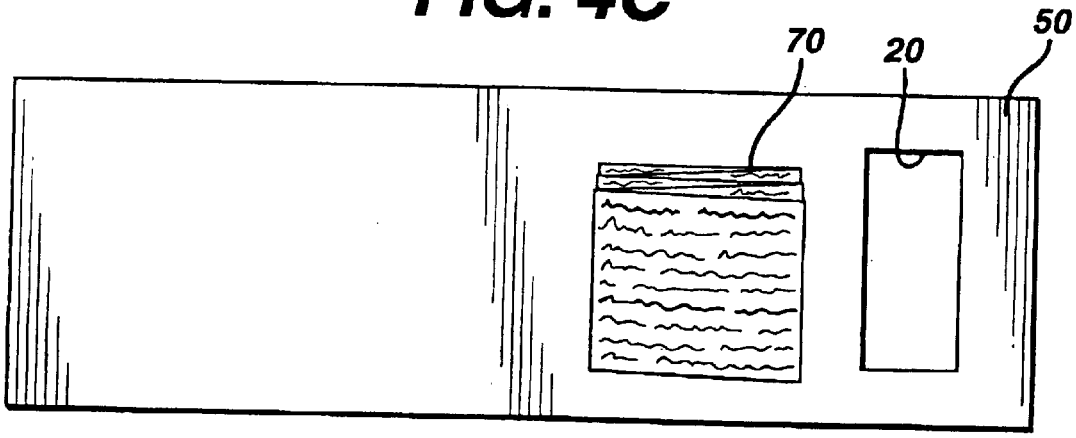

FIG. 4 is perspective view of the outer sleeve, the container not present. More particularly FIG. 4A is the outer sleeve with the window present and the information package present. FIG. 4B is a top view of the outer sleeve of the package wherein the information package in booklet form. FIG. 4C is a top view of the information package in a foldout pamphlet form. (Note to Lee Hamiel please provide this additional drawing, see U.S. Pat. No. 5,866,219 for ideas)

Figure 5A:
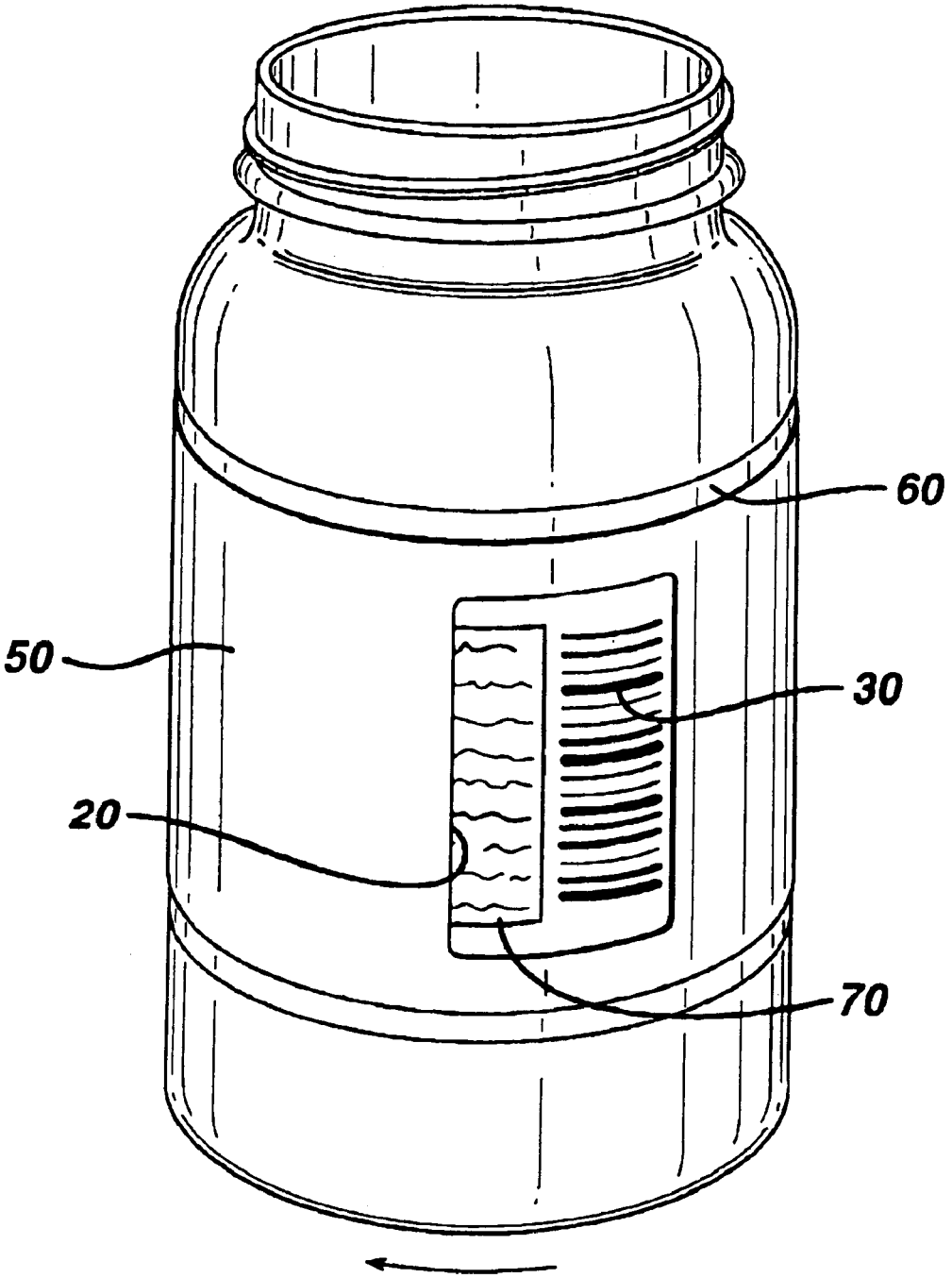
Figure 5B:
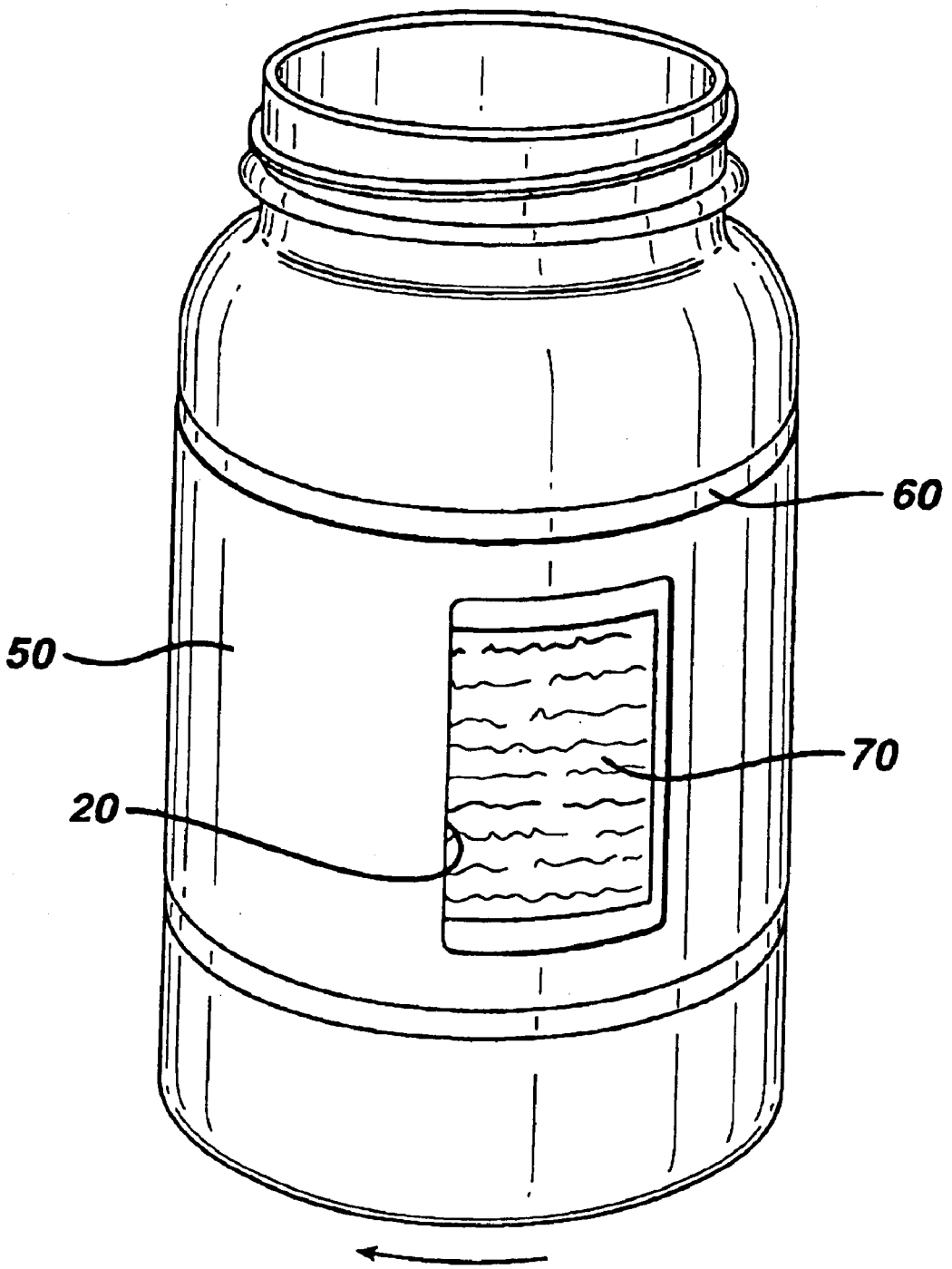
Figure 5C:
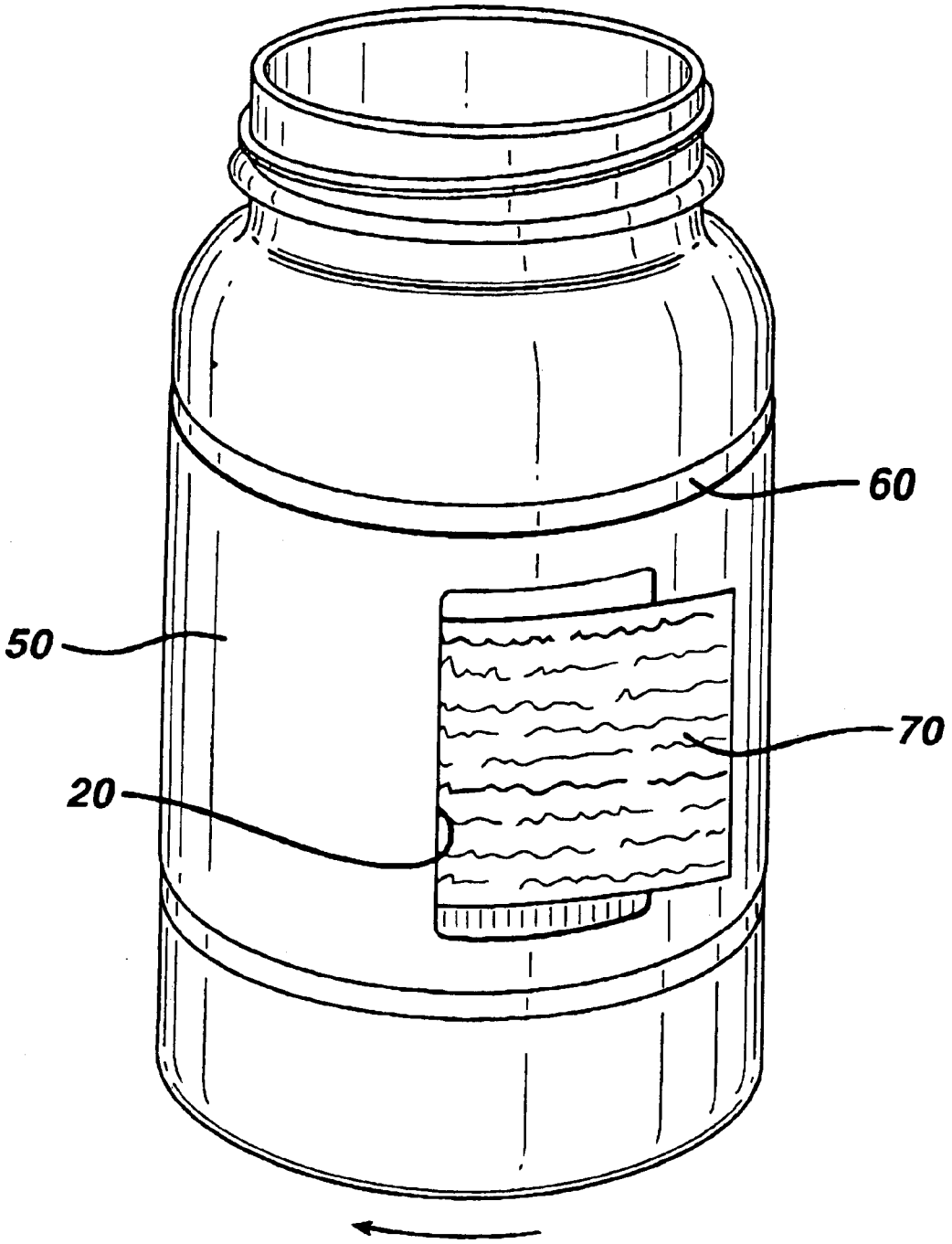

FIGS. 5A, 5B, and 5C are side views of the invention showing the opening sequence for the information package. In FIG. 5A, upon rotation of the container, the information package is beginning to appear. FIG. 5B depicts about half of the information package extending through the window, and FIG. 5C the information package is extended in its entirety through the window.

Figure 6:
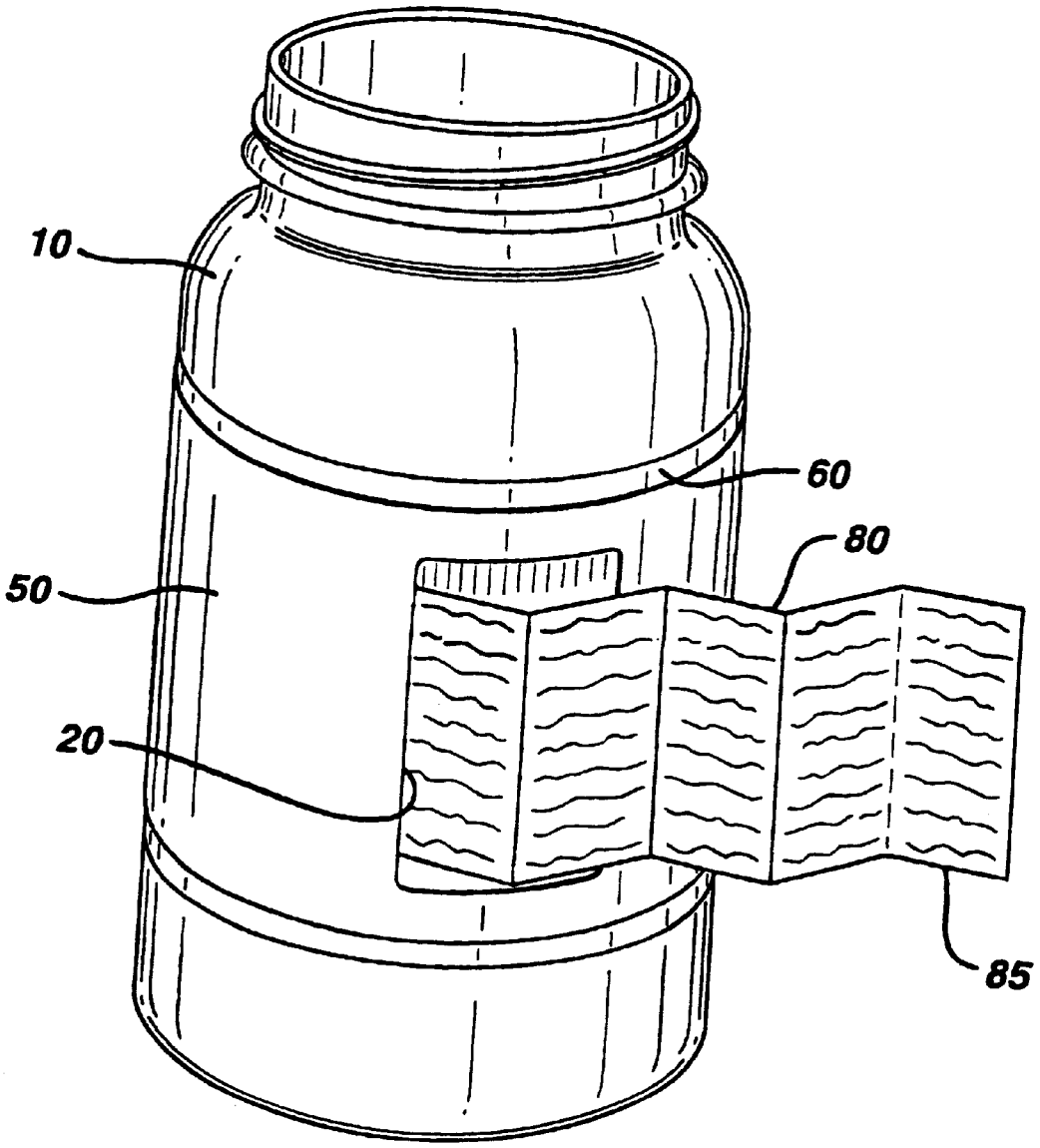

FIG. 6 is a perspective view of the container with an pamphlet-type information package in the extended position, with the last page having a perforated edge so as to be easily detachable from the remainder of the label.

Figure 7:
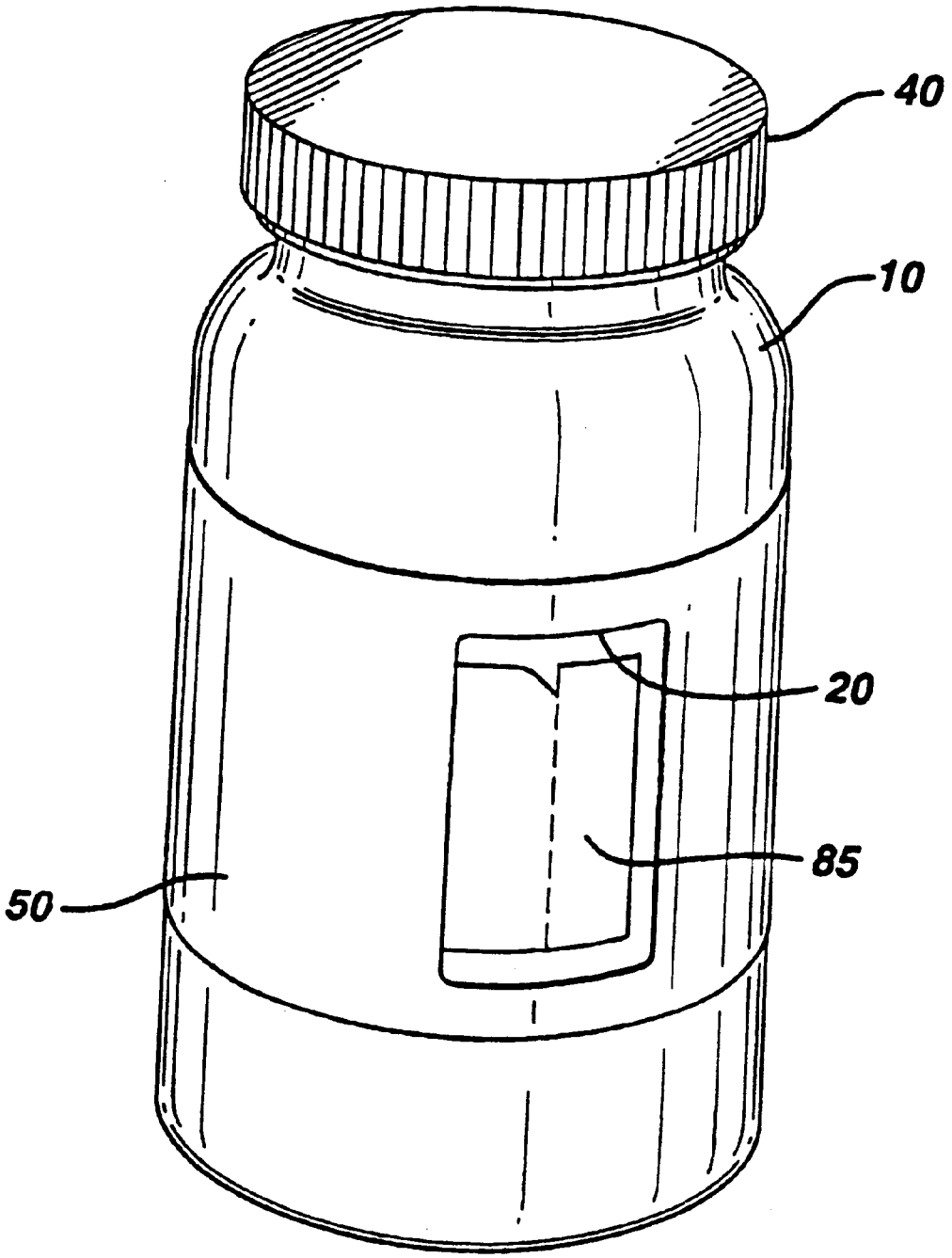

FIG. 7 is a perspective view of the container with a perforated tab that retains the information package in place prior to sale.

DETAILED DESCRIPTION OF THE INVENTION

Figure 1:
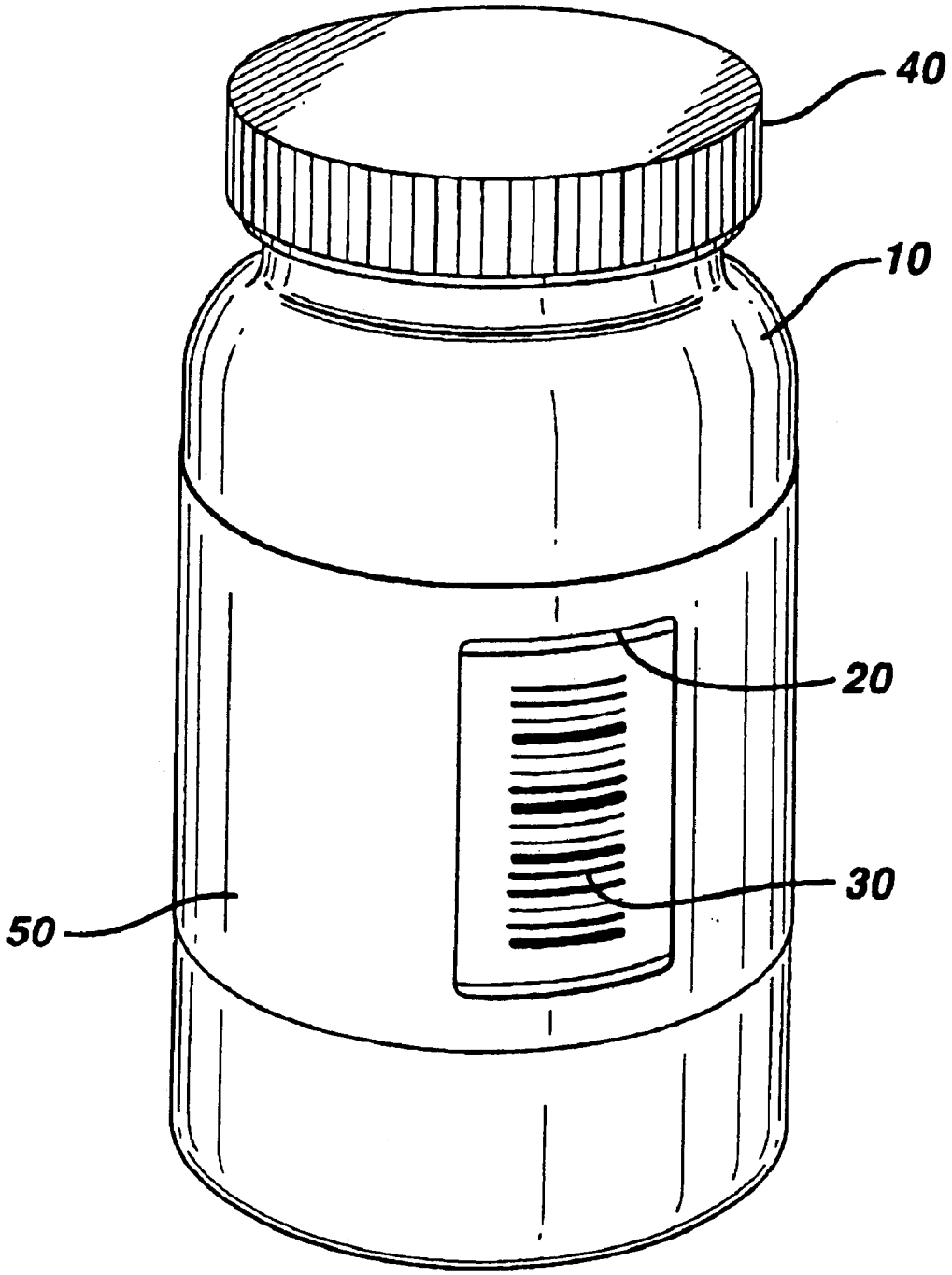
FIG. 1 is a perspective view of the container and window in the closed position, with a bar code, i.e., the universal product code (UPC) appearing in the window.

Referring to FIG. 1, the container 10 with the window 20 in the outer sleeve 50 is shown. In an initial position, the Universal Product Code (UPC) 30, is shown in the window. The UPC is depicted as vertical lines in the figure. The UPC would be a preferred item to be initially depicted in the window so that when the consumer purchases the container, the UPC is easily found. The cap 40 to the container is also shown.

Figure 2:
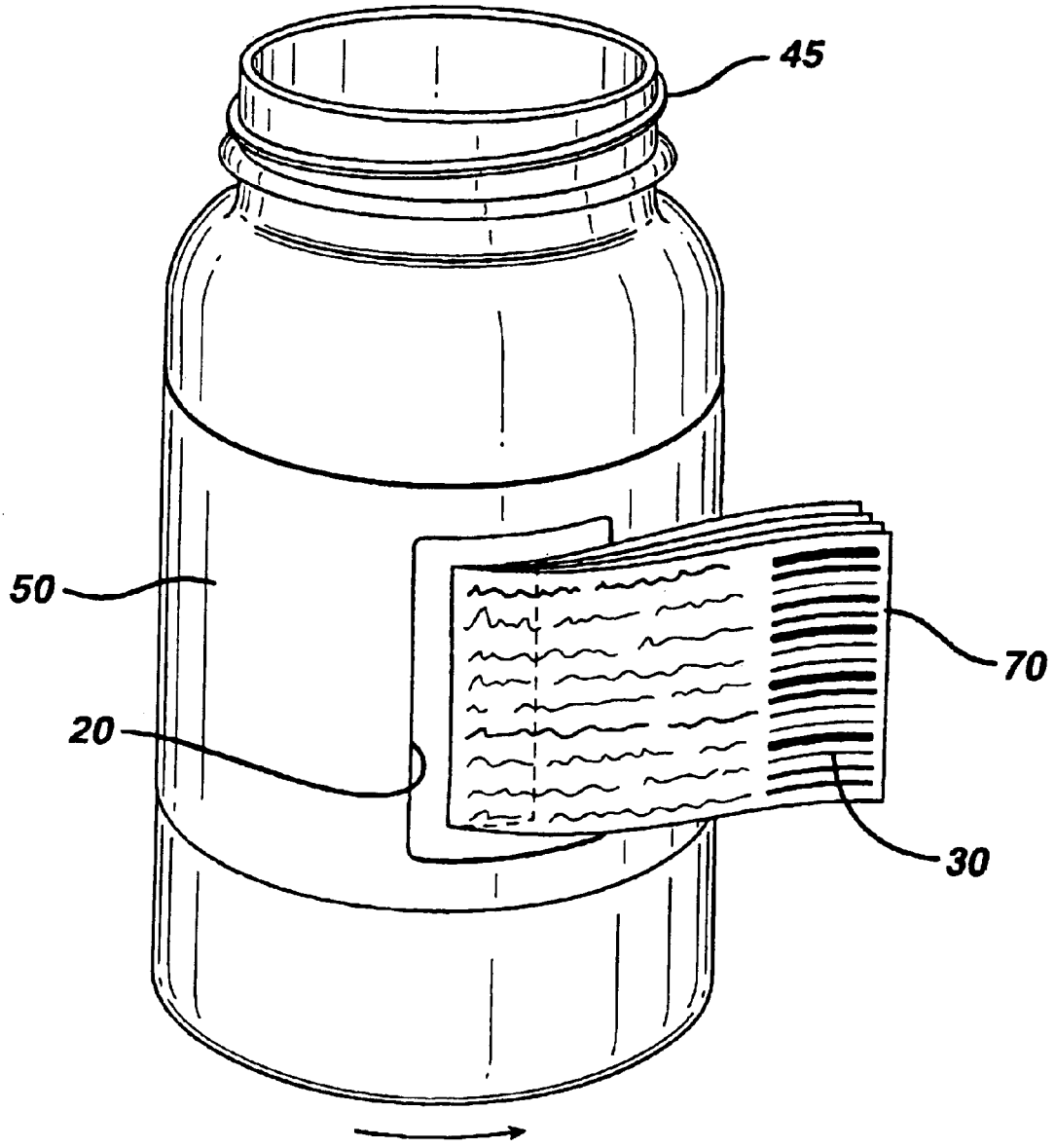
FIG. 2 is a perspective view of the container with the information package fully extended.

Referring to FIG. 2, the information package, in this figure depicted as having a booklet is shown. The information package 70 is depicted as horizontal lines. The cap is not shown in this figure, instead the container threads 45 are shown. The outer sleeve 50 is also depicted.

Figure 3:
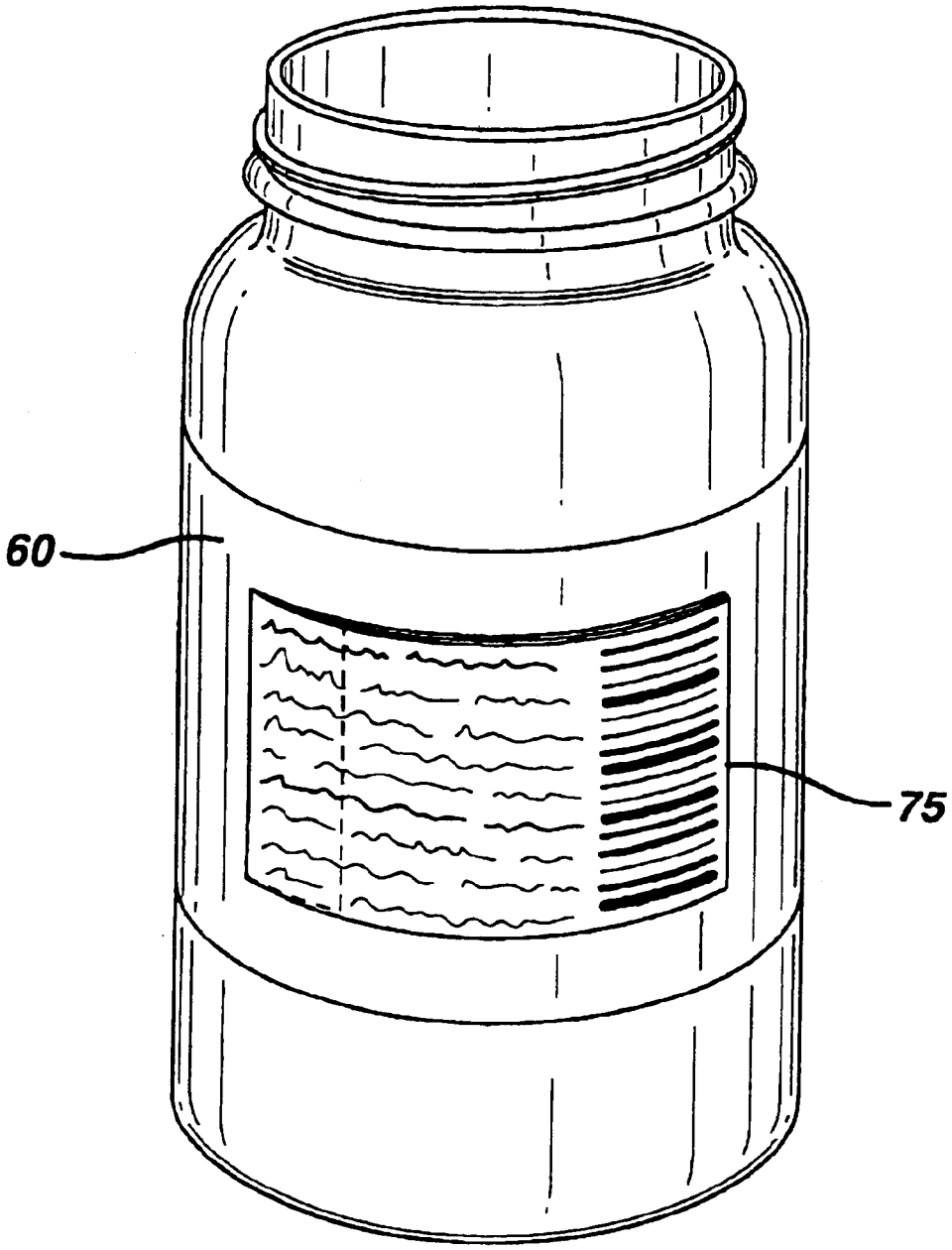
FIG. 3 is a perspective view of the container with the inner sleeve depicted and the information package attached to the inner sleeve. The outer sleeve has been removed for a better view of the interior.

FIG. 3 depicts the container with the outer sleeve removed. The inner sleeve 60 is shown which in a preferred embodiment is attached to the container. Suitable attachment means include adhesives, tapes, ultrasonic welding, of which adhesives are preferred. As depicted in FIG. 3, the inner sleeve preferably contains a flap 75 which extends from the inner sleeve. In the figure a single flap is depicted, although the flap may contain a hinged flap with more than a single page of information or provided pamphlet form.

The information flap 75 can also act as a stop in the rotation of the container and inner sleeve. When the container is rotated the flap acts as a stop, meaning that the container can no longer be rotated any further in that direction. Preferably the container is rotated a minimal amount before the information package is provided through the window. In a preferred embodiment, the container is rotated less than about a half revolution, that is less than 180 degrees of rotation, preferably less than a quarter turn rotation, about 90 degrees before the entire information package is provided through the window.

Now referring to FIG. 4, the outer sleeve is depicted without the container. The views found in FIG. 4 are the reverse side of the outer sleeve, that is the side of the inner sleeve not visible to the consumer when purchasing the container. In FIG. 4A, a side view of the outer sleeve 50 is shown with the window 20. The information package 70 in a booklet form 70 is depicted. The information package is attached to the outer sleeve. In FIG. 4B depicts the information package 70 viewed in a folded format, i.e. FIG. 4C provides a top view of the outer sleeve with the information booklet folded into a folded pamphlet-like package 71.

FIG. 5 depicts the opening of the information package found on the container. The container 10 and the inner sleeve 60, which in preferred embodiment attached to the container, is rotated in a counterclockwise manner as depicted by the arrow. The UPC 30, the vertical lines are still visible, but the information package 70 is becoming extended through the window and is becoming more visible. In FIG. 5B, the information package 70 is beginning to extend so as to completely cover the window 20 and the UPC 30 is barely visible. In FIG. 5C, the information package 70 is fully extended. To retract the information package 70 the container is then rotated in the opposite direction. The information package 70 is then retracted inside the outer sleeve, this is easily accomplished while holding the outer sleeve stationary. In a preferred embodiment the outer sleeve is free to rotate, while the inner sleeve is attached to the container. Suitable attachment means include adhesives, heat shrinkable materials, hook and loop fasteners and the like.

As used in the specification, the term information package includes various embodiments such as a single page, booklets and pamphlets, and in a preferred embodiment with pages with a hinge to form a book-like package which is available when extended.

FIG. 6 depicts the information package, shown as a pamphlet 80 fully extended from the window 20. In a preferred embodiment of the invention, a detachable means 85 such as a perforation is provided. For example it might be useful for a rebate coupon is provided for a future purchase, or information package to be collected and then redeemed in the future. Those with skill in the art will readily recognize that the detachable item does not have to be in the last page of the pamphlet. Other embodiments include detachable pages from booklet forms or even detachable and resealable systems as described in U.S. Pat. No. 5,866,219 hereby incorporated by reference.

FIG. 7 depicts the perforation tear tab 85 in the inner sleeve. The other items identified in FIG. 7 have the same meaning as set forth above. The tear tab prevents the informational package to be opened accidentally or prior to sale of the product. This will prevent the informational package from being removed, or damaged prior to it being read by the consumer and also functions as a tamper resistance feature.

The present invention with the retractable information package provides many advantages. The information package is capable of providing a great deal of information when needed, but can be easily put back into a storage position when not needed. When the information package is in the storage position, the information package remains clean, and is not likely to be detached when not in use. The informational package can also be made such that it is removable for the inner sleeve through the use of various adhesives. Resealable informational packages are set forth in U.S. Pat. No. 5,866,219, the contents of which incorporated by reference as if forth in their entirety.

The container can be made of various materials, including glass, polymers, metals and the like. Most preferably the container is made of a polymer material such as polyethylene, polypropylene, polyethylene terpthalate (PET), polyvinyl chloride (PVC), polycarbonate, copolymers and blends of polymers. The preferred material for construction of the container is polyethylene.

The inner and outer sleeve is made of any suitable material that can be used to provide printed material. Various materials such as paper, or wax-coated paper, polymers, copolymers or other suitable materials which can be easily printed on can be used as the sleeve materials. It is preferable that the materials selected for the inner and outer sleeve have a low coefficient of friction. That is the materials should be easily rotated over each other. Certain materials, such as some plastics, may be difficult to slide over each other. Preferably the materials, or combination of materials selected for incorporation for the inner and outer sleeves will smooth rotate over each other.

In a highly preferred embodiment of the invention the container contains threads or other suitable means which are compliant with a container to join the cap and the container. In a highly preferred embodiment, the cap and container include child resistant cap which are well known in the art. Suitable examples are disclosed in U.S. Pat. Nos. 3,795,338 and 3,857,505, the contents of which are incorporated by reference in their entirety. These patents and other similar embodiments known to those with skill in the art require pressure to engage projections extending upwardly from the walls of the container. In the absence of sufficient pressure the cap will ratchet over the projections, and not permit the cap to open. Other child resistant caps require pressure to be applied to the top or side of the cap in order to engage the projections to open the cap.

The containers of the present invention are suitable for containing solids and liquids. The materials to be included in the containers include pharmaceuticals, vitamins, pesticides, fertilizers, cosmetics, personal hygiene products, and the like.

While the present invention has been described with reference to certain preferred embodiments, those with skill in the art will recognize that various modifications many be provided without departing from the spirit of the present invention. Variations upon and modifications to the described embodiments are provided from by the present invention, which is limited only by the following claims.

What is claimed is:

1. A product information label system comprising:

a) a container suitable for holding material;

b) an inner sleeve in contact with said container;

c) an outer sleeve in contact with the inner sleeve;

d) a window in said outer sleeve;

e) an information package, wherein said information package is extended through said window when the container is rotated.

2. The product information label system of claim 1 wherein the inner sleeve is attached to the container.

3. The product information label system of claim 1 wherein the inner sleeve and outer sleeve are made of the same material.

4. The product information label system of claim 1 wherein said window depicts a universal product code.

5. The product information label system of claim 1 wherein said window depicts a removable tab.

6. The product information label system of claim 1 wherein said information package contains multiple pages of information.

7. The product information label system of claim 6 wherein said information package is in the form of a booklet.

8. The product information label system of claim 6 wherein the information package is in the form of a pamphlet.

9. The product information label system of claim 6 wherein the booklet has printed materials on both sides of the pages.

10. The product information label system of claim 2 wherein said window is provides a removable tab.

11. The product information label system of claim 10 wherein said removable tab must be removed prior to the rotation and the extension of the information package.

12. The product information label system of claim 1 wherein the inner sleeve is not visible.

13. The product information label system of claim 1 where the outer sleeve does not cover the inner sleeve.

14. The product information label system of claim 1 wherein the inner and outer sleeves are both made of paper.

15. The product information label system of claim 1 wherein the Universal Product Code is originally visible and when the container is rotated the information pamphlet covers said UPC.

16. The product information label system of claim 1 wherein said container is rotated less than 180°.

17. The product information label system of claim 16 wherein said container is rotated less than about 90° in order to fully extend said information package.

18. A method for providing information to a consumer comprising:

providing a container;

providing an inner sleeve in contact with the container;

providing an outer sleeve in contact with the inner sleeve;

providing a window in the outer sleeve;

providing an information package with the outer sleeve;

rotating the container to provide the information package through the window in the outer sleeve.

* * * * *

UNITED STATES PATENT AND TRADEMARK OFFICE

CERTIFICATE OF CORRECTION

PATENT NO. : 6,360,462 B1
DATED : March 26, 2002
INVENTOR(S) : Ronald E. Mengel

It is certified that error appears in the above-identified patent and that said Letters Patent is hereby corrected as shown below:

Column 5,
Line 17, please delete the word "is"

Signed and Sealed this

Sixteenth Day of December, 2003

JAMES E. ROGAN
*Director of the United States Patent and Trademark Office*